United States Patent [19]

Dahmberg et al.

[11] Patent Number: 4,869,170

[45] Date of Patent: Sep. 26, 1989

[54] DETONATOR

[75] Inventors: Sven Dahmberg, Stockholm; Elof Jönsson, Nora; Per Lilius, Gyttorp; Ingemar Olsson, Nora; Hjalmar Hesselbom, Huddinge; Rolf Wennergren, Sollentuna, all of Sweden

[73] Assignee: Nitro Nobel AB, Gyttorp, Sweden

[21] Appl. No.: 155,280

[22] Filed: Feb. 12, 1988

[30] Foreign Application Priority Data

Feb. 16, 1987 [SE] Sweden ..... 8700604

[51] Int. Cl.[4] ..... F42C 19/12

[52] U.S. Cl. ..... 102/202.5; 102/200; 102/202.8

[58] Field of Search ..... 102/200, 201, 202.5, 102/202.7, 202.8, 206

[56] References Cited

U.S. PATENT DOCUMENTS

| | | | |
|---|---|---|---|
| 4,391,195 | 7/1983 | Shann | 102/201 |
| 4,586,437 | 5/1986 | Miki et al. | 102/206 |
| 4,712,477 | 12/1987 | Aikou et al. | 102/206 |
| 4,730,558 | 3/1988 | Florin et al. | 102/202.7 |

FOREIGN PATENT DOCUMENTS

| | | |
|---|---|---|
| 0208480 | 1/1987 | European Pat. Off. . |
| 0212111 | 1/1987 | European Pat. Off. . |
| 1488893 | 10/1977 | United Kingdom . |
| 2164730A | 3/1988 | United Kingdom . |
| 1498 | 3/1986 | World Int. Prop. O. . |

OTHER PUBLICATIONS

O'Neill, Timothy; "The Status of Tape Automated Bonding"; Semiconductor International; pp. 33–50; 1981.

Small, D. J.; "Tape Automated Bonding and its Impact on the PWB"; Circuit World, vol. 10, No. 3, pp. 26–29; 1984.

*Primary Examiner*—Charles T. Jordan

*Attorney, Agent, or Firm*—Burns, Doane, Swecker & Mathis

[57] ABSTRACT

A firing unit for initiation of detonators, which contain at least one base charge in a detonator casing, which firing unit comprises an electrically actuable fuse head, a current source connected to the electrically actuable fuse head via switching means, and an electronics unit comprising a signal decoder designed so as to distinguish a start signal supplied to the detonator via an external signal conductor, a delay circuit designed in such a way that, when the start signal is received, it supplies an ignition signal after a predetermined time and the switching means, which are designed in such a way that, when the ignition signal is received, they connect the current source to the fuse head in order to electrically actuate the latter, the electronics unit comprising at least one chip made from a semiconductor material and having a microcircuit. According to the invention, at least the chip and an additional component are electrically and mechanically connected on a substrate having a circuit pattern. The chip can support the electrically actuable fuse head on its surface and the circuit pattern can contain a spark gap, made in a thin metal layer. The invention also relates to detonators equipped with a firing unit as described above.

50 Claims, 3 Drawing Sheets

DETONATOR

TECHNICAL FIELD

The present invention relates to a firing unit for initiation of detonators, which contain at least one base charge in a detonator casing, and a finished detonator with such a firing unit. The invention relates more particularly to a firing unit of this type with electronic delay of the firing signal.

BACKGROUND

In most blasting operations different charges in a round are triggered sequentially with a certain time delay between individual charges or groups of charges. This makes possible control of the rock movements during blasting, in order, for example, to maintain a free expansion surface for all charges in the round, to affect rock fragmentation and displacement, and to control the ground vibrations.

The delay is achieved conventionally by means of a pyrotechnical delay element arranged in the detonator, the length and burning rate of which element determine the delay time. When the delay element has been fired by the initiation signal, it burns at a predetermined rate and subsequently initiates the explosive in the detonator. A certain time scatter is, however, unavoidable even in the case of accurately produced pyrotechnical elements. Since a relatively large number of different delays are required, delay elements of different pyrotechnical compositions and burning rates must be used, which increases the risks of undesired scatter because of the different ageing properties of the various elements. Moreover, because the pyrotechnical delay element has a given burning time, a large range of detonators must be produced and stocked. For reliable ignition the element must rest against the explosive in the detonator, which makes it difficult, in the field or on the premises, to assemble the desired range of detonators.

Different proposals for electronic detonators have been put forward in which the pyrotechnic delay is replaced by an electronically generated delay. By this means the precision of the detonator delay time can be considerably improved and also made non-sensitive to storage. If the detonator is made programmable, the same detonator type can be used for many different delays, and possible delay times can be chosen at will and do not require to be standardized in advance. Apart from the electronics part, the detonator can be made as simple as a normal instantaneous detonator.

Commercialization of electronic detonators has been held back by several problems. It has been found difficult to reduce the price of the relatively complicated electronic circuit to the level of the pyrotechnic element. Even if the major part of the electronics can be designed as a single semiconductor chip, the circuit solution must in addition comprise at least one discrete component, such as, for example, a current source for powering of the electronics during the delay phase and for ignition of the fuse head. These components and their mutual electrical and mechanical connections increase considerably the costs of the electronic detonator. The circuit must, in spite of the easily damaged components, satisfy essentially the same mechnacial strength requirements as the considerably more robust parts of a pyrotechnic element, i.e. withstand relatively careless handling during assembly of the detonator, during connecting up of the round, and during severe ground vibrations and shock waves from adjacent detonations during the delay phase. A strong mechanical construction does however conflict with the desired objective of being able to produce the electronics detonator in the same shell dimensions as previously, which have been more or less standardized, and of being able to use the existing assembly equipment. Reliable ignition imposes limitations on the possibilities of reducing the size and electrical energy requirement of the fuse head. The precision of the electric delay is counteracted by the dead time and the resulting time spread in the remaining parts of the firing chain, such as the fuse head and charges in the detonator. The possibility of reducing the response time of the fuse head is limited by the capacity of the current source. Miniaturization of the electronics, which is desirable per se, increases the sensitivity to static electricity and other disturbances, which, in the context of explosives technology, represents a safety problem. The mechanically sensitive electronic components also make difficult the final assembly of the detonator and in particular the possibilities of simple local assembly of prefabricated parts.

THE INVENTION IN GENERAL

One object of the present invention is to remove or to reduce the abovementioned problems. A particular object of the invention is to make possible an accurate electronic firing unit for detonators at a low price. Another object is to provide a firing unit with small dimensions, suitably matched to existing detonator sizes. A further object is to provide a firing unit with a good electrical and mechanical connection of the components in the electronics part, by which means good manageability and vibration resistance are achieved. A further object is to make possible a firing unit with low sensitivity to disturbance. Yet another object is to provide a firing unit which can be handled and transported independently and which lends itself to simple final assembly with the remaining parts of the detonator. Another object is to make possible a firing unit with a fuse head which provides reliable ignition, has a low energy requirement and also small and uniform inherent delay.

These objects are achieved by means of the characteristics which emerge from the patent claims.

According to one aspect of the invention, the components of the electronics part are mounted on a substrate, preferably flexible, with an imprinted conductive pattern. The mounting technique is inexpensive and fast, inter alia because a continuous production process is made possible in which components are mounted and transported between different production stations on a continuous substrate which is not cut into individual units until in the final stage. If the substrate is a thin film, this makes possible finished units of low weights and small volumes. The technique does not require any encapsulation of the chip but permits direct connection between contacting areas of the chip surface and the substrate surface, respectively, by which means additional weight and volume savings can be made. Since chips and at least one additional component, but preferably all the components in the electronics part, are mounted on the substrate, the electronics unit thus formed is compact, the wiring short, the sensitivity to interference low and the interconnections fewer. At the same time the production-technology advantages extend to the whole electronics unit. The flexibility of the substrate provides good resistance to pressure, impact and vibrations without risk of interruption in the circuit pattern or at the connections to the components. These advantages are particularly pronounced in combination with the weight reductions which are also made possible. According to another aspect of the invention a separate firing unit is formed by encapsulating electronics and fuse head. By this means an independently manageable and transportable firing unit is achieved without any explosive components, which, without high demands on precision, can be finally assembled in a detonator casing with explosive charges by being introduced at a suitable distance above the primary charge. In combination with a flexible substrate the following additional advantages are obtained, namely that the accessible space permits encapsulating in the form of a strong holding fixture and that the positions of the components can be controlled by means of the design of the holding fixture during flexing of the substrate. According to a further aspect of the invention the fuse head, i.e. fuse bridge and priming composition is placed directly on the surface of the chip. By this means the sizes of these components can be reduced, the mechanical stability increased, the sensitivity to disturbance reduced, the energy requirement reduced and the response time reduced, in part due to omission of extra conductors between the substrate and a switching means on the chip. The positioning provides good mechanical stability and reliable adherence between primer and fuse bridge. If the fuse head is located on the same side as the microcircuit on the chip, the production of the fuse bridge is simplified, particularly if the bridge is produced at the same stage as other necessary structures on the surface. The positioning is highly compatible with the option of using unencapsulated chips and the option of mounting at contact areas around a hole in the substrate through which the primer can be exposed. In this connection a flexible substrate provides the possibility of good control of a spark shower in the direction towards the primary explosive of the detonator. According to yet another aspect of the invention, the electronic detonator is protected from disturbance by means of spark gaps arranged in thin metal layers and with stable flash-over voltage, non-sensitive to the gap distance. The spark gaps can, without extra cost, be advantageously made directly in the circuit pattern of the substrate.

Further objects and advantages of the invention will emerge from the more detailed description which follows.

DETAILED DESCRIPTION OF THE INVENTION

The principles of the invention can be applied to all types of detonators where a delay or possibility of delay is desired and where an electrical initiation step is incorporated in the firing chain. Following the electrical initiation there is an explosive base charge of a highly explosive secondary explosive, such as PETN, RDX, HMX, Tetryl, TNT etc., possibly with an intermediate firing-chain stage in the form of, for example, a primary explosive such as lead azide, mercury fulminate, trinitroresorcinate, diazodinitrophenolate, lead styphnate etc. The advantages enumerated above are of most value in connection with civil detonators, and the invention will be described in connection with this application. Civil detonators are often connected in networks with requirements for different delays in different parts. A suitable detonator for civil use comprises, in addition to the firing unit according to the invention, an essentially cylindrical detonator shell which can be of paper, plastic etc., but which is generally of metal, containing base charge and, where appropriate, primary explosive and, at its open end, a sealing with signal conductors passed therethrough. Known instantaneous detonators intended for application on and initiation by safety fuses can advantageously be used.

A firing unit for initiation in the abovementioned types of detonators should comprise an electrically actuable fuse head, a current source connected to the electrically actuable fuse head via switching means, and an electronic delay unit, which electronic delay unit in turn should comprise a signal decoder designed so as to distinguish a start signal supplied to the firing unit via an external signal conductor, a delay circuit designed in such a way that, when the start signal is received, it delivers an ignition signal after a predetermined time, and the switching means which is designed in such a way that, when the ignition signal is received, it connects the current source to the fuse head in order to electrically activate the latter, the firing unit containing at least one chip made from semiconductor material with a microcircuit. In order to make possible different delays for a plurality of detonators connected up in a network, these can be designed in advance in such a way as to provide different delays or can be preferably designed in such a way as to be programmed, during connecting-up or blasting, to the desired delay.

The exact circuit solution for carrying out the abovementioned functions can be varied within wide limits and the present invention is not limited in this respect. Known proposals for circuit solutions emerge for example from U.S. Pat. Nos. 4,145,970, 4,324,182, 4,328,751 and 4,445,435 and European Patent Specification 0,147,688, which are hereby incorporated by reference.

According to one aspect of the present invention, a flexible substrate with an etched circuit pattern is used in order to mechanically and electrically connect chips to, for example, external signal conductors and/or one or more additional electric components in the firing unit. Examples of additional components are other chips, the electrically actuable fuse head, the current source, conversion circuits for in--coming signals, safety elements such as resistors, insulation transformers, spark gaps, other voltage-limiting devices, devices for earthing to the detonator casing etc. Normally at least the current source and chips are supported by the film. Preferably not more than one chip is included in the circuit.

From space aspects it is desirable to place as many of the circuit functions as possible on the chip, but other considerations must also be made. In principle at least all low effect circuits such as decoder or delay cicuits are located in the chip, while high effect circuits such as current source, safety circuits and switching means for the fuse head and other components which cannot be made in semiconductor material, such as crystal oscillator, current source etc., can be located externally. Certain high effect circuits which can be made in semiconductor material, such as the switch for the fuse head, voltage limiters and rectifiers can advantageously be incorporated on the chip or form a separate chip. The chips can be designed using known technology, such as a bipolar technique or preferably CMOS technique, in order to minimize the energy consumption.

The flexible substrate is to be pliable but, in other respects, shape-permanent and non-elastic in order to prevent interruption in the circuit pattern and can therefore advantageously be cross-linked. The material should furthermore be heat-resistant in order to permit component assembly by heating. Examples of suitable materials are organic polymers such as epoxy/glass, polyester and in particular polyimide (for example Kapton from du Pont). The substrate can advantageously be made of a relatively thin film and should then have a thickness not exceeding the thickness of the chip. Preferably the thickness does not exceed 1 mm and is more preferably below 0.5 mm and most preferably below 0.25 mm. For reasons of strength the thickness should exceed 0.01 mm and preferably also exceed 0.05 mm.

A circuit pattern is to be formed on the substrate, and this can be done by providing the surface with a metal layer which is etched, in a conventional manner by means of photoresist, to give the desired pattern. The metal can advantageously be copper, which is electrodeposited or is glued in the form of a foil to the substrate, for example with epoxy or acrylate polymer. The thickness of the layer can be between 5 and 200 μm and in particular between 10 and 100 μm. When the circuit pattern has been formed, the metal surface can be plated with a thin layer of a durable metal such as gold or tin in a thin layer of for example 0.1 to 1 μm in thickness. The circuit pattern is to fulfil the function of electrically connecting the different components to each other, but it can also be used to produce certain types of components, such as spark gaps, resistors etc., as will be further illustrated below.

The discrete electronic components are mounted on the circuit pattern formed. This can be effected conventionally by the component connections being passed through holes in the substrate and soldered to the circuit pattern. Small components can be surface-mounted directly on the circuit pattern without through-leads. Tongues of the circuit pattern metal can be freed from the substrate and connected to the components. This is carried out most simply at holes in the substrate which have been made before the metal coating, in which connection the reverse of the metal coating at the holes is protected in a particular way during etching. The component leads or preferably even the component itself can be positioned in the hole in order to increase the mechanical stability. Hereby the tongues can be advantageously folded up from the plane of the substrate and connected to the component. Connection can generally be made via wires or preferably directly to the components. The connection can be made by means of thermocompression, fusion or preferably by means of soldering depending on the nature of the metals brought together. In the case of soldering, an extra supply of soldering metal is generally required in addition to the plating metal possibly present.

The chip can be mounted in the same way as described above for the other components. An encapsulated chip can thus be soldered by its contact legs to corresponding points on the substrate, where appropriate after the legs have been passed through the substrate. However, as mentioned above, it is advantageous to connect the contact areas of the chip to the substrate more directly, by which means, inter alia, it is possible to use completely or partially unencapsulated chips. Connection of contact areas on the chip and substrate, respectively, can be made, for example, by means of metal wires in a conventional manner, by which means the contact areas on the substrate need not be uniform with the contact areas on the chip.

A preferred method of making the connection is by means of the known TAB technique (Tape Automated Bonding) described for example by O'Neill: "The Status of Tape Automated Bonding", Semiconductor International, Feb. 1981, or Small: "Tape Automated Bonding and its Impact on the PWB", Circuit World, Vol. 10, No. 3, 1984, which are hereby incorporated by reference. In addition to the production-technology advantages, importance is also attached in this context to the fact that the contact is in this way strong and vibration-resistant. The circuit pattern on the substrate is designed with contact areas of sizes and positionings adapted for direct bearing on the contact areas of the chip. Additional metal is supplied between the two contact surfaces, on the one hand to facilitate good intermetallic connecting and on the other hand to provide a distance between the surface of the chip and the plane of the circuit pattern on the substrate. For this purpose a column of a suitable metal, such as copper, tin, lead or in particular gold, is electrodeposited either on the contact areas of the chip, generally of aluminium, or on the contact areas of the substrate. The cross-sectional area of the column is to be adapted to the size of the contact area of the chip and can be, for example, 50 to 150 μm square. The column can be formed directly on the contact areas of the film when the remainder of the circuit pattern has been sealed, for instance in a second step, with photoresist. Alternatively columns can be formed by etching away of material in the circuit pattern of the substrate around the intended column area. A plating of the resulting column may then be required if appropriate. When the column is built in the preferable way on the chip, additional protecting layers are generally provided in order to prevent the long-term effects of the circuit contact metals of the semiconductor material, which are normally placed on an insulating layer of, for example, silicon dioxide on the semiconductor surface. In general the entire surface is first passivated with silicon nitride, the passivation is removed at the contact areas, diffusion barriers or barrier metal of, for example, copper, titanium, tungsten, platinum or gold are applied over at least the contact areas thus freed and preferably over the whole circuit area by means of vaporization or sputtering. The contact areas are shielded and the columns are electrodeposited on these, after which the surface around the contact areas is etched down to the passivation layer.

When columns have been grown on one of the contact surfaces, joining can take place by means of compression at heat sufficient for connection. Depending on the choice of material and temperature the joining is effected by means of melting, formation of eutectic or compression of softened metals. The temperature should be above 150° C. and preferably above 300° C. The chip can advantagenously be preheated but should not be brought to excessively high temperatures. The heating should mainly be carried out from the substrate side. It is possible to preheat the contact surfaces of the substrate to the desired temperature before joining or to heat through the substrate. However, a preferred method is to produce the connection at a hole in the substrate across whose edges the contact areas of the circuit pattern freely project, by which means these contact areas are directly accessible for pressing, by means of a hot tool, against the surfaces of the chip. In this way the two surfaces of the chip are otherwise completely free and accessible for, for example, support and adjustment by means of a holding fixture. In this connection the tool can be passed through the substrate while the microcircuit surface of the chip is directed towards the pattern surface of the substrate. However, it is preferable for the chip to be passed through the hole in the substrate to a position with its microcircuit surface flush with the pattern surface of the substrate, by which means the chip bears against the freely projecting contact tongues of the substrate from below while the hot tool approaches from the top side of the substrate. In this way the circuit surface of the chip can be best exposed and controlled by an external holding fixture.

If desired, the naked chip and its contacts can, after the connection, be sealed by, for example, a silicon elastomer or epoxy polymer.

The firing chain which will result in the detonation of the detonator base charge is started by some form of an electrical initiation, a resistor generally supplying an explosive or combustible or otherwise reactive material in a primer with sufficient heat to initiate the reaction. The initiation can be due to heat or a shock wave or a combination of mechanisms such as in the case of sparks or electric arcs. Exploding films or wires can be used, but the heat release is preferably intensified by means of a chemically reactive material, for example by means of an alternately oxidizing and reducing material in the fuse bridge, such as copper oxide and aluminum, or a metal layer which, when heated, is alloyed during heat release, such as aluminium combined with palladium or platinum.

The reactive material in the primer can be explosive, such as a primary explosive of the abovementioned types, for example lead azide, which can be detonated by the electrical initiation, in which connection the detonation can be directly conveyed further to subsequent charges in the detonator. If the reactive material is non-detonating when influenced by the electrical initiation element, an additional step is required in the firing chain for transition to detonation. This can be effected most simply by the reaction products from the reactive material affecting a primary explosive. If it is desired to omit the primary explosive, other known transition mechanisms can be used, such as impact against a secondary explosive of a mass accelerated by burning powder or deflagrating secondary explosive (Flying Plate) or combustion of secondary explosive under conditions such that the reaction leads to detonation (DDT, Deflagration to Detonation Transition). A preferred type of DDT construction is disclosed in PCT/SE85/00316, which is hereby incorporated by reference.

A preferred type of non-detonating reactive materials are pyrotechnic compositions which generate a flame or sparks. These do not have to be positioned in the immediate vicinity of the subsequent stages in the firing chain but can bridge a certain distance to these. Moreover, non-detonating reactive materials have the advantage of facilitating the handling of the firing unit before assembly in a detonator. Known compositions for fuse heads can be used based on mixtures of oxidizing materials, such as oxides, chlorates, nitrates, and reducing materials such as aluminium, silicon, zirconium, etc. These are often pulverulent and bound together by a binding agent such as nitrocellulose or polyvinyl nitrate. Explosive substances such as lead azide, lead dinitrophenolates or lead mono- or di-nitroresorcinate can be incorporated to a lesser extent in order to facilitate the ignition. The oxidizing and reducing materials are normally pulverulent with a mean particle size of less than 20 μm and preferably even less than 10 μm. The primer can be formed in the normal way by means of the components being slurried in a solution of the binding agent. The solvent is evaporated after formation for hardening and binding to the fuse bridge.

A conventional fuse head with a bridge wire can be used in the construction according to the invention. In order to reduce the demands on the current source or to reduce the response time it is, however, desirable to make the fuse head and in particular the bridge wire smaller than normal. The mass of the bridge wire, or in general the impedance part of the fuse circuit, should be less than 1 microgram and preferably even less than 0.1 microgram. It may be necessary to guide the spark stream through shieldings to subsequent parts of the firing chain. A conventionally designed fuse head can be mounted on the substrate as an additional component in accordance with what has been described above. A fuse bridge of small mass can more easily be produced by thin-film technology on a support and connected as an additional component. An even more compact construction is obtained if a fuse bridge is designed as a part of the circuit pattern of the substrate and the primer is applied directly to this. The bridge can be formed as a thinner or narrower part of the conducting circuit pattern, but it is preferably designed in another material with higher resistivity, for example nickel/chromium, by means of thin-film technology.

According to one aspect of the present invention, a free part of an at least partially unencapsulated chip is used as a support for fuse bridge and primer. If a plurality of chips are incorporated in the detonator, the primer is expediently applied to a chip containing the switch element for the fuse circuit, such as a thyristor switch.

The fuse bridge can be applied on the reverse of the chip, i.e. a side without circuits, by which means the design can be made extremely freely with a minimum of effect on the other functions of the circuit. However, it is preferred for the fuse bridge to be applied on the front, i.e. the processed side with the microcircuit, since this facilitates production of the bridge and application of the primer by means of steps similar to those used in the manufacture of the circuit pattern and facilitates connection between these circuits and the fuse bridge and also assembly and connection to other electronic components. In this connection the fuse bridge can be applied on a part of the surface which does not support any circuit pattern, in which connection the effect on the circuit is minimized or permits a design of the bridge in semiconductor material, for example in order to obtain resistance decreasing with temperature in accordance with what is described in U.S. Pat. No. 3,366,055. By locating the fuse devices on top of the microcircuit the volume and price are reduced, since especially the fuse head is large compared to the chip. In this connection some form of electrical insulation is required between the overlappling parts and for this purpose, in the production of semiconductor circuits, normal insulating layers can be used, such as vapox or polyimide. The thickness of these layers can be, for example between 0.1 and 10 μm.

If heat release constitutes an essential part of the firing mechanism it is preferred to have, underneath the fuse bridge, a heat-insulating layer in order to reduce the heat losses to the strongly heat-conducting silicon substrate and thereby to reduce the response time and power requirements. The heat-insulating layer can be made of the same material as for electrical insulation, for example silicon dioxide, vapox, but it can be of increased thickness, for example up to over 0.5 μm and in particular up to over 1 μm. The thickness should also be chosen taking into consideration the risk of burning-through before the primer has ignited. Other conceivable insulating materials are in particular heat-resistant organic substances such as polyimides, which can be used in the manner which is disclosed by, for example, Mukai: "Planar Multilevel Interconnection Technology Employing a Polyimide", IEEE Journal of Solid State Circuits, Vol. Sc. 13, No. 4, Aug. 1978, or Wade: "Polyimides for Use as VLSI Multilevel Interconnection Dielectric and Passivation Layer", Microscience, p. 61, which are hereby incorporated by reference.

A further reason for arranging a special layer between fuse bridge and chip is to avoid affecting the chip by substances in the primer. Since a chip with primer must be at least partially unprotected there is also a risk of a negative effect on the chip from substances in the other parts of the detonator, for example substances evaporated from the main charges of the detonator. High temperatures may occur in the interior of detonators, for example on exposure of the detonator to sunlight.

Suitable materials as diffusion barriers can be metal layers. Such which almost completely cover each other, can be arranged in the same layer as the fuse bridge or in an overlying layer isolated from this. Insulating materials such as those mentioned above are preferred. These can be placed between the primer and bridge but are preferably placed beneath the bridge.

The primer may be slightly electrically conductive and it may therefore be expedient to arrange an insulating layer directly under the primer, preferably directly on top of the layer with the fuse bridge, in order to prevent undesired electrical contact between different parts of the surface. The abovementioned insulating materials can be used, preferably a plastic layer. Windows must be etched in this layer, on the one hand over the fuse bridge and on the other hand at the electrical contact surfaces of the chip.

Altogether, at least one layer of non-electrically conductive material should thus be arranged between primer and chip surface and preferably at least one such layer between fuse bridge and chip surface, in which connection one layer can of course fulfil several of the abovementioned functions. In general contact holes are required in these layers, for example for the electrical contact surfaces.

On top of the layer or layers the fuse bridge is constructed which can be designed, for example, as a spark gap igniter but preferably as a resistor with current supply conductors. In this connection the current supply conductors are expediently formed in a metal film with low resistivity by means of, for example, vacuum deposition, which is connected to the underlying layer on the circuit pattern of the semiconductor surface. The resistor part can be designed as a thinner or preferably narrower part between the current supply conductors and of the same material as the latter. However, the fuse bridge itself is preferably designed in a material with higher resistivity than in the current supply conductors. This can be suitably achieved by means of a circuit with current supply conductors and a bridge being etched from a double layer consisting of a lower layer of high resistivity and an upper layer of low resistivity. In this circuit the bridge itself is then formed by means of the upper layer being etched away. The current in the current supply conductors thus principally flows in the upper layer, with low resistivity, towards the bridge where the current is forced downwards into the lower layer, with high resistivity. In addition to suitable resistivity, the material should have a melting point exceeding the required ignition temperature for the reactive material, for example more than 400° C. and preferably more than 500° C. If the chip is to be connected to other components by means of TAB technology as described above, the fuse bridge can advantageously be formed during the same operation and of the same material as the barrier layer, since the latter is in general applied over the whole circuit area and is then masked away by means of photolithography and etching. In this way the current supply conductors and bridge can be obtained without extra production stages. Several of the metals enumerated above for the object have suitable properties even as resistance material, for example titanium and tungsten, individually or alloyed, and an overlaying layer of, for example, gold can serve as a low resistivity material. In this connection the TAB technique should thus be used by which metal columns are grown on the contact areas of the semiconductor rather than on the contact areas of the film.

The geometry of the fuse bridge is not critical as long as the required power can be produced in a stable manner. However, it is preferred that the bridge be designed with a thin cross-section for production purposes and in order to increase the contact surface with the primer, for example with at least 10 and preferably at least 50 times as great a width as thickness. Where the fuse bridge is narrower than the current supply conductor it is furthermore preferred that the transition be made rounded off in order to avoid undesired local heat release as a result of current disconcentration. A suitable shape for the bridge has proved to be an essentially square surface of sides between 10 and 1000 μm and in particular between 50 and 150 μm and a thickness between 0.01 and 10 μm and in particular between 0.05 and 1 μm. The fuse bridge can, for example, be designed in such a way that, at a current strength of between 0.05 and 10 or preferably between 0.1 and 5 amperes, it brings a layer of the primer to an ignition temperature of above 500° and preferably above 700° C. within a time period of between 1 and 1000 microseconds or in particular between 5 and 100 microseconds.

On top of the bridge there is deposited the primer which, for example, can consist of the components enumerated above. The amount thereof is relatively uncritical since ignition takes place in an extremely small area, but it should be kept as small as reliable ignition of later stages in the firing chain permits. The amount can, for example, be less than 100 mg and even 50 mg, but it should exceed 0.1 mg and even 1 mg. In the case of pulverulent components in the primer it should be ensured that a binding agent with good adhesion to the fuse bridge is incorporated in order to ensure effective heat transfer in this surface before the primer is shattered. The binding agent or other continuous material in the primer is preferably an easily ignitable explosive such as nitrocellulose.

The primer can be applied to the chip before the chip is mounted on the substrate, but it is preferable for this to be carried out after mounting. If the contact surfaces of the chip are protected during application, variations can be permitted in the positioning and extension of the primer, allowing a plurality of application methods, such as dipping, potting, pressing etc. However, it is preferred that the primer be centred well within the contact areas of the chip, especially if the charge has a significant conductivity. This can be carried out by a drop of viscous suspension being precision-deposited by means of a cannula onto the fuse bridge of the chip surface. When the solvent evaporates, the pulverulent components in the primer bind to each other and to the fuse bridge. After drying, the fuse head can advantageously be coated with a lacquer layer in order to further improve the stability and to contribute to containment of the reaction.

The principles for positioning of the fuse bridge on the chip can be used independently of the further connection of the circuit to the electronics in the firing unit. However, as indicated above, advantages are achieved in combination with TAB technology in production. The absence of encapsulation is used both for the contacts and the exposure of primer. The connections obtained are strong and resist vibrations well. Assembly at holes in the substrate permits good positioning of the primer along the surface of the substrate. Flexible substrates provide, in addition, the possibility of good adjustment of the position of the primer by means of flexing of the film and low screening effects with another assembly method than along the surface of the substrate.

The firing unit according to the invention shall contain means for receiving a start signal supplied to the detonator. If a chargeable current source is used, for example in a preferred manner a capacitor, it may also be necessary to supply the detonator with energy for charging of the current source. It is then expedient to use the same means for both functions. Said means expediently comprise a conductor extending from the inside of the detonator and related contacts for this inside the detonator. The conductor can be connected in a conventional manner to a blasting apparatus directly or via interconnected sound or radio stages as proposed, for example, in U.S. Pat. Nos. 3,780,654, 3,834,310 or 3,971,317. The conductor can be a fibre optic cable, by which means simplicity and extremely high insensitivity to disturbances can be achieved, and the means in the detonator in this case comprise a photoelectric energy converter. The conductor can also in a conventional manner contain one or more metallic wires, whereby only a connection between the wires and the circuit in the firing unit is required.

Electrically initiated detonators should normally be protected against unintentional detonation caused by uncontrollable electrical phenomena such as lightning, static electricity, detonation-generated voltages, disturbances from radio transmitters and power lines, and faulty connection of the conductors. The detonators should not be triggered by the moderate effect of such phenomena and should moreover preferably be capable of functioning after at least normal disturbances of this type, such as static discharges and detonation-generated voltages. Normally electric detonators are equipped with spark gaps, intended to limit the voltage, and, where appropriate, also resistors, intended to limit disturbance currents in the circuit. The presence of integrated circuits and other miniaturized electronics in detonators makes these potentially more sensitive to disturbances, and it is desirable both to lower the limit of permitted voltage and to reduce the response time in the safety circuits.

It has proved expedient also in electronic detonators to arrange spark gaps in order to limit disturbance voltages. Spark gaps should be arranged both between the lead wires and between each conductor and detonator casing and/or earth. The spark gaps should be designed in such a way as to be conductive at voltages below 1000 V, preferably below 800 V and especially also below 700 V. However, the ignition voltage must be well above the working voltage of the electronics and may not normally be made any lower than 300 V. The necessary precision in the flash-over voltage can be obtained by conventional design but more simply if the gap is designed as a thin metal layer in which the flash-over voltage is determined more by the point effect from the thin layers than by the width of the gap. The film thickness should then be kept below 500 μm, preferably below 100 μm and especially also below 50 μm. Production problems and re-increasing flash-over voltage can be expected with extremely thin films, and the film thickness should therefore exceed 1 μm and preferaly even 5 μm. An optimum in operation should be sought between these approximate limits. It is particularly advantageous to form the spark gaps directly on the circuit pattern surface for inter-connecting the electronic components, since then no extra component and no extra production stage are required. If the substrate for the circuit pattern is the above-described flexible substrate, an additional advantage is that smaller variations in the gap size as a consequence of flexing or vibrations in the film affect minimally the flash-over voltage of the spark gaps.

Since an electronic circuit of the present type necessarily contains many conductors with small mutual isolation distances, it should be ensured that natural or specially provided impedances are arranged after the spark gap and that the isolation distances, including the spark gaps, in front of these impedances be kept smaller than after the impedance in order to thereby guide the flash-over to the area at the spark gaps. It is preferred that in particular flash-over voltages between conductors and detonator casing be controlled in this manner, i.e. that the isolation distance between shell and current supply conductor is less in front of the impedance than after the same. The impedance can also function as a current limiter and as a fuse for subsequent components. It is preferable to connect a resistance in series in at least one and preferably both of the current supply conductors following the spark gap. A capacitance between the conductors can be used as a supplement or as an alternative. The capacitance increases the rise time of the voltage to which safety components between the conductors are exposed, which increases in particular the probability of these safety components, such as spark gaps, safety thyristors or Zener diode, triggering rapidly enough. The impedance can, like the spark gaps, advantageously be made directly on a circuit pattern substrate, for example by thin-film technology or thick-film technology or otherwise mounted as discrete components. The isolation distances on the chip itself are necessarily small, and it is preferable for extra safety circuits to be arranged before or on the chip. The safety component can, for example, be a Zener diode, but it is preferably of the thyristor type in order to give low residual resistance and low heat release.

When the necessary components have been mounted on the flexible film according to the invention, this should be introduced into a holding fixture in order to protect the components and to lock and stabilize their positions. A suitably designed holding fixture also permits the firing unit to be transported and handled separately, which, in the context of explosives, is of considerable advantage. The holding fixture should support at least the flexible substrate over a consideable part of its area. The holding fixture can also support or at least limit the range of movement of the other components, the inside of the holding fixture essentially corresponding to a casting of the substrate and components. The outside of the holding fixture should be designed so as to provide correct positioning in a detonator casing with a sufficient number of contact points with the inner surface of the casing. The outer surface is preferably designed essentially cylindrical corresponding to the inside surface of the detonator casing, the diameter of which in general is less than 20 mm, usually even less than 15 mm and preferably even less than 10 mm. If the firing unit in a preferred manner comprises a primer, this is located in that side of the said holding fixture directed towards the interior of the detonator, and an opening, which can be provided during transport with removable or breakable sealing, into the primer is to be arranged in the holding fixture for exposure and control of the spark shower or the flame. By means of the holding fixture and the flexible substrate satisfactory guidance of even a small primer is achieved for effective spark concentration in the desired direction. The other end of the holding fixture can be designed as a sealing plug for sealing of the detonator following introduction of the firing unit. The sealing plug and holding fixture can in this connection be made integrally of the same material, which provides good stability and moisture-proofing and also simplifies the production. Alternatively, the plug and holding fixture can be produced from different materials, in which connection the choice of material can be optimized for the respective function, for example an elastomer in the plug and a thermoplastic, such as polystyrene or polyethylene, in the holding fixture. The parts can be held together simply by means of the conductor, but it is preferable for an additional connection to be achieved, for example by means of a simple mechanical locking or by means of fusion. There should also be an inlet for the current supply conductor, or connector for the current supply conductor. The holding fixture should include an opening for earthing contact between the circuit and the detonator casing which is normally of metal. This earthing can be designed as a metal tongue which passes from the substrate plane out through the holding fixture and is led out over the outside of the holding fixture, or preferably as an enlarged metal-coated part of the substrate which extends through the side of the holding fixture. The holding fixture can also include openings at special parts of the circuit, for example for control measurement or for programming. Thus, the electronics can be given an identity, for example by means of burning of fusible links or by means of so-called Zener-zap technology according to the above before assembly in the detonator casing in order to permit, for example, subsequent individual time programming. The holding fixture is expediently made of a non-conducting material such as a plastic. The firing unit can in this connection be cast into the plastic material, for example by means of a casting mould being applied around the substrate whereupon a solidifying polymeric material, preferably a cold-setting resin, is injected into the mould. However, it is preferable for the holding fixture to be formed separately, expediently with a division in the plane of the film surface for simple insertion of the film. The parts can, where appropriate, be held together by a simple locking arrangement. All openings in the holding fixture may advantageously have moisture-proof seals of, for example, plastic film or fusings in order to increase the operational efficiency following separate handling and transport.

A preferred embodiment of the invention will now be described with reference to the accompanying drawings.

LIST FOR FIGURES

FIG. 1 shows a section of a continuous substrate for formation of a plurality of circuit pattern substrates, FIG. 2 shows, in a view from above, an individual flexible film with circuit patterns but without mounted components, FIGS. 3*a* and 3*b* show, on an enlarged scale, two layers of the surface of a chip, FIG. 3*c* shows a block diagram of the electronic unit, FIG. 4 shows, in a side view, the detonator with a holding fixture containing substrate with mounted components, FIG. 5 shows schematically an optical cable and photoelectric converter.

Figure 1:
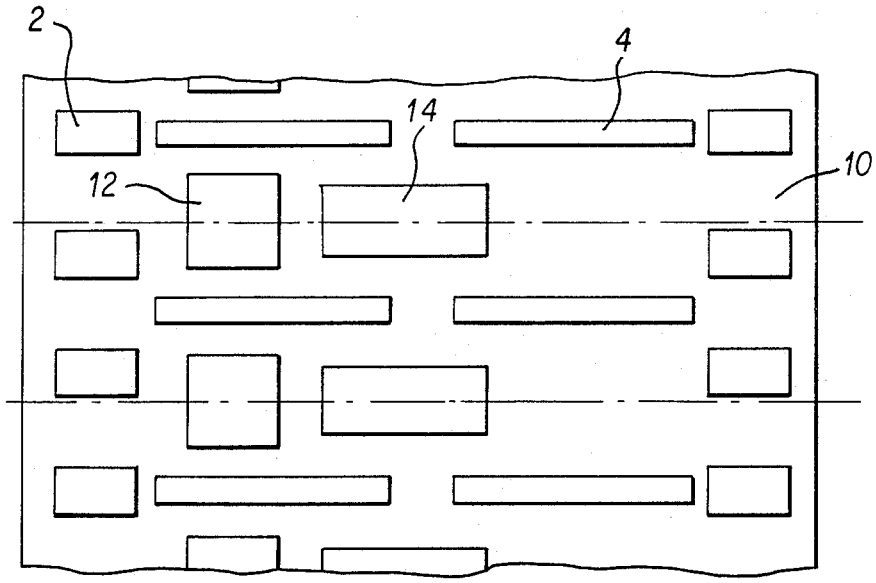
In FIG. 1 reference 10 indicates a continuous flexible polyimide film of a width of 35 mm and a thickness of 125 μm. On the film 10, with feed perforations 2, there are made elongate holes 4 for facilitating cutting into individual circuits, holes 12 for mounting of chips and holes 14 for mounting of components. The surface is covered with a 35 μm thick copper film by means of an approximately 8 μm thick adhesive layer of acrylic polymer. By means of photoresist and acid, patterns are etched according to FIG. 2, with approximate sizes of 6 times 24 mm, the bottom side of the copper film at the holes 12 and 14 being protected against acid by means of sealing. When the circuit pattern has been formed, it is tin-coated with an approximately 0.8 μm thick layer of tin.

On the pattern there are two terminal surfaces 16 and 16' on which the lead wires are subsequently soldered. Two conductive parts 18 and 18' lead to two tongues 20 and 20' between which there is a spark gap of about of 100 μm. Between another tongue 22 and the tongues 20 and 20' there are formed additional spark gaps of the same sizes which permit spark-over from any conductor to the detonator casing by virtue of the fact that the tongue 22 is connected, via conductors beneath the resistors 26 and 26', to projecting parts 24 and 24' of the pattern, which parts, when the film is introduced into a detonator of metal, will earth the tongue 22 to the detonator casing. At the tongues 20 and 20' there are contact areas 28 and 28' for connection by means of soldering of approximately 2 kohm thick-film resistors 26 and 26', shown in the figure by broken lines, in series with each conductor. The conductors 32 and 32' run parallel and wave-like in order to increase the series inductance and they connect the contact areas 30 and 30' of the resistors 26 and 26' with two tongues 34 and 34' at the hole 14 for mounting of a semiconductor chip 50, shown in the figure by means of broken lines. Across circuits on the chip these tongues 34 and 34' are connected with the tongues 36 and 36' which in turn lead to contact tongues 38 and 38' at which a 33 μF tantalum capacitor 40, shown by broken lines, is subsequently soldered after completion of the tin layer and when the capacitor has been placed in the hole 12 and the contact tongues projecting over the hole have been turned up towards the sides of the capacitor 40. A plurality of contact pads 41, 42, 43, 44 and 45 with contact tongues towards the chip lack electrical contact to the rest of the conductive pattern and serve as probe fields, by means of which fusible links on the chip can be affected, or for improving the mechanical fixation of the chip.

Figure 3A:
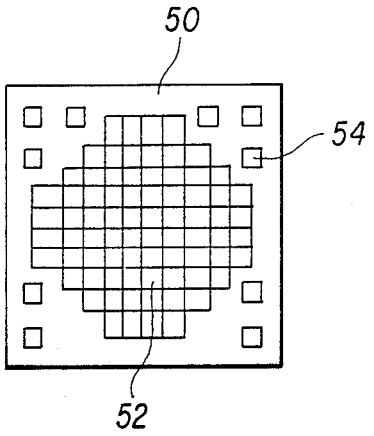
Figure 3B:
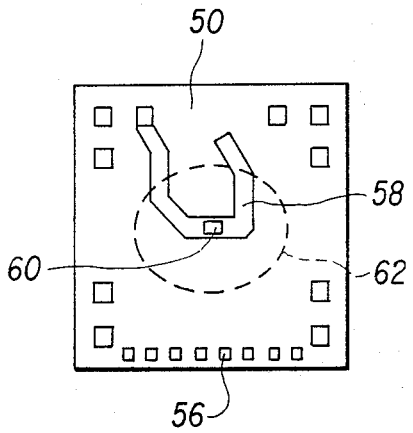

FIG. 3*a* shows schematically the conventionally designed microcircuit on the chip 50 comprising functional circuits 52 and contact areas 54 of aluminium. This surface is insulated in a normal manner by a thin layer of silicon oxide, after which holes are made at underlying contact areas, primarily the contact surfaces 54 but also special connecting points for the fuse bridge and fusible links. The surface is coated with an approximately 1 μm thick layer of polyimide by means of dropping, spinning and thermo-setting, after which holes are made in the layer corresponding to the holes in the vapox layer. Onto the polyimide layer there is applied an approximately 0.25 μm thick layer of titanium-tungsten alloy and an approximately 0.25 μm thick layer of gold by means of sputtering. An approximately 20 μm thick layer of photoresist is applied, masked and developed in such a way that the gold layer is exposed over the contact surfaces which are to be provided with contact columns, over an approximately 100 times 100 μm large area, after which gold columns of approximately 30 μm in height are formed on these surfaces by means of electrodeposition, after which the thick photoresist layer is removed. After this the completely covering titanium/tungsten and gold layers should normally be etched away, but before this is carried out a new layer of photoresist is applied, masked and developed in such a way that, after etching, the structures according to FIG. 3*b* are left. These structures are made up on the one hand of fusible links 56, having fuse points, connected to points on the microcircuit in such a way that blowing at the fuse points can be produced with current surges of 2 mJ of energy by which means a binary 8-digit number can be formed for identification of detonators individually or by group. A fuse bridge 58 is also formed, with a resistive area 60 approximately 100 μm square in size having a resistance of approximately 4 ohm. The high resistance area 60 on the fuse bridge 58 or the fuse points on the fusible links 56 are obtained by means of the gold layer having been removed here such that the current is forced down into the more resistive Ti/W-layer. An approximately 1 μm thick polyimide layer is applied over the whole surface by the method indicated above, after which an area around the point 60 of the fuse bridge, the fuse points of the fusible links and the contact columns are exposed. The chip treated in this way is connected to the film by being pre-heated to approximately 200° C. and passed, with its circuit surface first, through the hole 14 to contact with the underside of the tongues around the hole 14, which tongues are pressed from the top side of the film towards the gold-coated contact surfaces of the circuit by means of a tool which is instantaneously heated to approximately 500° C. On the fuse bridge 58 there is placed a primer with an approximate extension according to the broken line 62, by means of the fact that approximately 5 mg of a composition consisting of zirconium/lead dioxide powder mixture in a weight ratio of 11:17 with a binding agent of nitrocellulose dissolved in butylacetate is placed on the chip surface and then air-dried at approximately 50° C., after which the fuse head and the remainder of the chip surface are lacquered with nitrocellulose lacquer.

Figure 2:
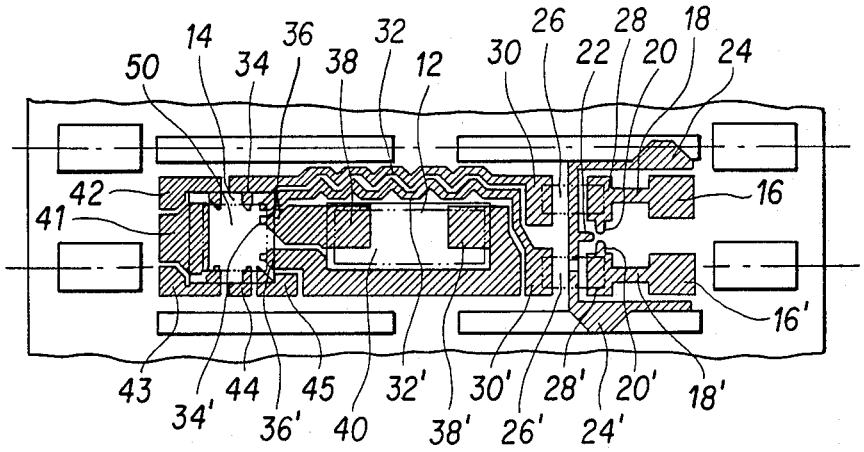
Figure 3C:
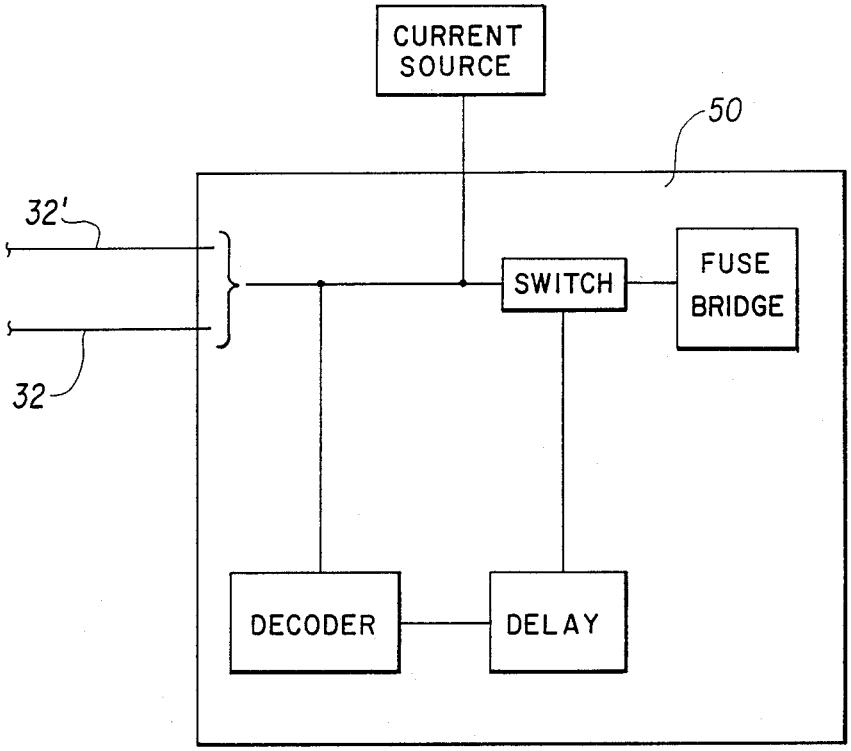

FIG. 3*c* shows generally the main components of the microcircuit on chip 50, as depicted in FIG. 3*a*. Incoming leads 32 and 32' connect to the chip, for example at the contact areas 34 and 34' of FIG. 2. A current source is connected in parallel with the incoming leads and is charged from an external source. Also connected to the leads is a decoder, designed to distinguish a start signal of predetermined characteristics supplied to the detonator via the external signal conductors. A delay circuit is designed to deliver, upon receipt of a start signal command from the decoder, an ignition signal after a predetermined delay. A switch is connected between the current source and the fuse bridge load and is arranged to connect these devices, when the ignition signal is received from the delay device, to electrically actuate the fuse head. The fuse bridge according to FIG. 3*b* is designed in a layer superimposed on the microcircuit described and appropriate connections are made between the layers.

Figure 4:
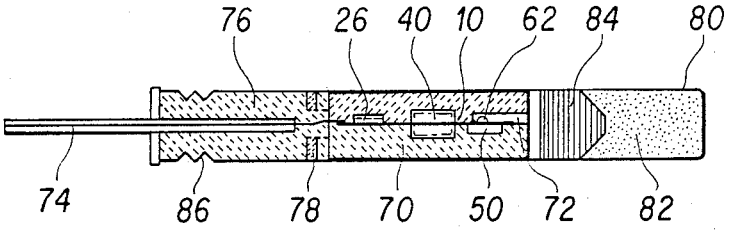

FIG. 4 shows a finished detonator containing a firing unit with a holding fixture 70 surrounding a flexible film 10 with mounted resistors 26, capacitor 40 and chip 50 with fuse head 62. The holding fixture 70 is essentially cylindrical with a diameter of 6 mm, has a dividing plane in the plane of the film surface 10 and, in the dividing plane, recesses for fitting, essentially free of play, around the components on the film. A channel 72 is arranged between the fuse head 62 and that surface of the firing unit directed towards the inside of the detonator. Lead wires 74 extend from that surface of the firing unit directed away from the inside of the detonator, and around these there is cast a sealing plug 76 of an elastomeric material. The holding fixture 70 is cast in polystyrene and is joined mechanically to the plug 76 at 78. The firing unit is introduced into a detonator 80 with a base charge 82 of, for example, PETN and a primary explosive charge 84 of, for example, lead azide located on top thereof, in which connection the front part of the firing unit is placed at a distance of approximately 2 mm from the primary explosive and the detonator is sealed with grooves 86 around the sealing plug 76.

Figure 5:
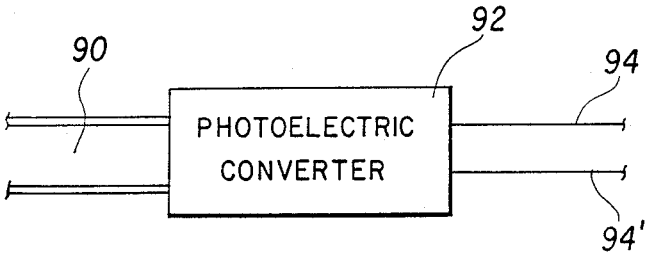

FIG. 5 depicts schematically an alternative embodiment in which the external signal conductor is not electrical wires but an optical cable. The optical cable 90 is passed into the detonator and abuts a photoelectric converter in which the optical signal is transformed into an electrical signal received at the output terminals 94 and 94'. This electrical signal may be further processed as described in the previous embodiment.

We claim:

1. A firing unit for initiation of detonators, which contain at least one base charge in a detonator casing, which firing unit comprises:

an electrically actuable fuse head, a current source connected to the electrically actuable fuse head via switching means, and an electronics unit comprising a signal decoder designed so as to distinguish a start signal supplied to the detonator via an external signal conductor, a delay circuit designed in such a way that, when the start signal is received, it supplies an ignition signal after a predetermined time and the switching means, which are designed in such a way that, when the ignition signal is received, they connect the current source to the fuse head in order to electrically actuate the latter, the electronics unit comprising at least one chip made from a semiconductor material and having a microcircuit, characterized in that at least the chip(s) and an additional electrical component are electrically and mechanically connected to each other on a substrate having a circuit pattern and in that the chip is connected to the substrate by means of direct connection between exposed contact areas arranged on the semiconductor surface and corresponding contact areas on the circuit pattern on the substrate.

2. A firing unit according to claim 1, characterized in that a holding fixture essentially encompasses the fuse head, current source, electronics unit, substrate and, where appropriate, comprises a sealing plug and in that the holding fixture has an opening for connection to the external conductor and an opening, where appropriate moisture-proof, for exposure of the primer.

3. A firing unit according to claim 2, characterized in that the holding fixture with the encompassed parts forms an essentially self-supporting and separately transportable unit which is suitable, when introduced into a detonator casing with base charge and where appropriate primary charge, for forming a complete detonator.

4. A firing unit according to claim 2, characterized in that the holding fixture is made of an electrically insulating material and comprises at least one opening for earthing contact between circuits included in the holding fixture and an electrically conducting detonator casing.

5. A firing unit according to claim 1, characterized in that the external signal conductor is a fibre optic cable and in that the firing unit comprises a photoelectric converter connected to the cable.

6. A firing unit according to claim 1, characterized in that a substantially cylindrical holding fixture encompasses the substrate and has a division in a plane of a film surface of the substrate for simple insertion of the film surface.

7. A firing unit according to claim 1, characterized in that at least one layer of connecting metal is applied between the contact areas of the substrate and semiconductor surface, respectively.

8. A firing unit according to claim 1, characterized in that the connection is arranged at a hole in the substrate across whose edges contact areas on the circuit pattern of the substrate freely project.

9. A firing unit according to claim 1, characterized in that the contact areas are arranged on the same side of the chip as the microcircuit.

10. A firing unit according to claim 1, characterized in that the chip supports the electrically actuable fuse head on its side provided with the microcircuit.

11. A firing unit according to claim 10, characterized in that the electrically actuable fuse head comprises a flat fuse bridge and a pyrotechnical element.

12. A firing unit according to claim 11, characterized in that the conductive pattern of the chip is divided into a lower and an upper conductive layer, which are mutally insulated except at windows for necessary contact between the layers and in that the fuse bridge is designed in the upper layer.

13. A firing unit according to claim 7 characterized in that the chip supports the electrically actuable fuse head on its side provided with the microcircuit, the electrically actuable fuse head comprises a flat fuse bridge and a pyrotechnical element, the conductive pattern of the chip is divided into a lower and an upper conductive layer which are mutually insulated except at windows for necessary contact between the layers and in that the fuse bridge is designed in the upper layer, and that the upper layer is incorporated in the connecting metal between the contact areas of the substrate and chip surface, respectively.

14. A firing unit according to claim 13, characterized in that the upper layer is a double layer with a high resistivity and a low resistivity layer and in that the low resistivity layer is removed at the fuse bridge.

15. A firing unit according to claim 3, characterized in that the holding fixture is made of an electrically insulating material and comprises at least one opening for earthing contact between circuits included in the holding fixture and an electrically conducting detonator casing.

16. A firing unit according to claim 1, characterized in that the circuit pattern of the substrate comprises at least one spark gap as a disturbance protection and in that an impedance is arranged in the circuit after the spark gap in order to guide flash-over voltages to the area at the spark gap.

17. A firing unit according to claim 16, characterized in that the spark gap is made of metal less than 100 $\mu$m in thickness.

18. A firing unit according to claim 1, characterized in that the substrate is flexible.

19. A firing unit according to claim 1, characterized in that the substrate is less than 1 mm in thickness.

20. A detonator comprising at least one base charge in a detonator casing, characterized in that it contains a firing unit according to claim 1.

21. A firing unit according to claim 8 characterized in that the chip supports the electrically actuable fuse head on its side provided with the microcircuit, and the primer is oriented in such a way that it is exposed through the hole in the substrate.

22. A firing unit for initiation of detonators, which contain at least one base charge in a detonator casing, which firing unit comprises:

an electrically actuable fuse head, a current source connected to the electrically actuable fuse head via switching means, and an electronics unit comprising a signal decoder designed so as to distinguish a start signal supplied to the detonator via an external signal conductor, a delay circuit designed in such a way that, when the start signal is received, it supplies an ignition signal after a predetermined time and the switching means, which are designed in such a way that, when the ignition signal is received, they connect the current source to the fuse head in order to electrically actuate the latter, the electronics unit comprising at least one chip made from a semiconductor material and having a microcircuit, characterized in that the chip made from a semiconductor material supports the electrically actuable fuse head on its surface, said fuse head comprising a resistor fuse bridge and a pyrotechnical composition.

23. A detonator comprising at least one base charge in a detonator casing, characterized in that it contains a firing unit according to claim 22.

24. A firing unit according to claim 22, characterized in that the chip supports the electrically actuable fuse head on its side provided with the microcircuit.

25. A firing unit according to claim 22, characterized in that the electrically actuable fuse head comprises a flat fuse bridge.

26. A firing unit according to claim 25, characterized in that a conductive pattern of the chip is divided into a lower conductive layer and an upper conductive layer, which are mutually insulated except at windows for necessary contact between the layers and in that the fuse bridge is designed in the upper layer.

27. A firing unit according to claim 26, characterized in that the upper conductive layer is incorporated in connecting metal between contact areas of a substrate of the electronics unit and a chip surface, respectively.

28. A firing unit according to claim 26, characterized in that the upper layer is a double layer with a high resistivity layer and a low resistivity layer and in that the low resistivity layer is removed at the fuse bridge.

29. A firing unit according to claim 22, characterized in that the chip is completely encapsulated.

30. A firing unit according to claim 22, characterized in that the chip is partially encapsulated.

31. A firing unit according to claim 22, characterized in that at least one layer of non-electrically conductive material is arranged between a primer and the chip surface.

32. A firing unit according to claim 31, characterized in that the at least one layer includes a heat-insulating material.

33. A firing unit according to claim 31, characterized in that the at least one layer includes a diffusion preventing material.

34. A firing unit according to claim 32, characterized in that the at least one layer includes a diffusion preventing material.

35. A firing unit according to claim 22, characterized in that the chip is connected to a substrate with circuit pattern by means of direct connection between exposed contact areas arranged on the semiconductor surface and corresponding contact areas on the circuit pattern on the substrate.

36. A firing unit according to claim 22, characterized in that a primer is oriented in such a way that it is exposed through a hole in a substrate for the chip.

37. A firing unit according to claim 22, characterized in that at least one spark gap is formed in the circuit pattern of the substrate.

38. A firing unit according to claim 22, characterized in that a substrate connected to the at least one chip is flexible.

39. A firing unit for initiation of detonators, which contain at least one base charge in a detonator casing, which firing unit comprises:

an electrically actuable fuse head, a current source connected to the electrically actuable fuse head via switching means, and an electronics unit comprising a signal decoder designed so as to distinguish a start signal supplied to the detonator via an external signal conductor, a delay circuit designed in such a way that, when the start signal is received, it supplies an ignition signal after a predetermined time and the switching means, which are designed in such a way that, when the ignition signal is received, they connect the current source to the fuse head in order to electrically actuate the latter, the electronics unit comprising at least one chip made from a semiconductor material and having a microcircuit, characterized in that at least one spark gap made in a thin metal layer is arranged in connection with an external signal conductor in the form of an electrical wire, the thin layer forming part of a substrate pattern surface of the electronics unit for interconnecting electronic components.

40. A detonator comprising at least one base charge in a detonator casing, characterized in that it contains a firing unit according to claim 39.

41. A firing unit according to claim 39, characterized in that the spark gap is conductive at voltages below 1000 V.

42. A firing unit according to claim 39, characterized in that spark gaps are arranged both between lead wires and between each conductor and detonator casing.

43. A firing unit according to claim 39, characterized in that spark gaps are arranged both between lead wires and between each conductor and earth.

44. A firing unit according to claim 39, characterized in that spark gaps are arranged both between lead wires and between each conductor and detonator and earth.

45. A firing unit according to claim 39, characterized in that an impedance is arranged in the circuit after the spark gap in order to guide flash-over voltages to an area at the spark gap.

46. A firing unit according to claim 39, characterized in that the spark gap is made of metal less than 100 μm in thickness.

47. A firing unit according to claim 39, characterized in that the spark gap is made of metal less than 50 μm in thickness.

48. A firing unit according to claim 39, characterized in that the chip is connected to the substrate with circuit pattern by means of direct connection between exposed contact areas arranged on a semiconductor surface of the chip and corresponding contact areas on the circuit pattern on the substrate.

49. A firing unit according to claim 39, characterized in that the chip supports the actual fuse head on its surface.

50. A firing unit according to claim 39, characterized in that the substrate is flexible.

* * * * *